US005937593A

United States Patent [19]

White

[11] Patent Number: 5,937,593

[45] Date of Patent: Aug. 17, 1999

[54] SECURITY CLOSURE

[75] Inventor: David A. White, Sevenoaks, United Kingdom

[73] Assignee: Vacant Property Security Limited, United Kingdom

[21] Appl. No.: 08/814,274

[22] Filed: Mar. 10, 1997

[30] Foreign Application Priority Data

Mar. 11, 1996 [GB] United Kingdom ..... 9605100

[51] Int. Cl.[6] ..... E06B 1/02; E06B 3/68

[52] U.S. Cl. ..... 52/106; 52/206; 52/DIG. 12; 49/57; 49/61; 49/62

[58] Field of Search ..... 52/206, 106, DIG. 12; 49/50, 57, 61, 62

[56] References Cited

U.S. PATENT DOCUMENTS

| | | | |
|---|---|---|---|
| 5,669,190 | 9/1997 | Szyjkowski | 52/196 |
| 5,673,883 | 10/1997 | Figueroa, Jr. | 248/200.1 |

FOREIGN PATENT DOCUMENTS

| | | | |
|---|---|---|---|
| WO 89/00637 | 1/1989 | European Pat. Off. . | |
| WO 91/16519 | 10/1991 | European Pat. Off. | 49/57 |
| 1594960 | 8/1981 | United Kingdom | 49/50 |
| 2160248 | 12/1985 | United Kingdom . | |
| 2210653 | 6/1989 | United Kingdom | 49/50 |
| 2268531 | 1/1994 | United Kingdom | 49/50 |
| 2274301 | 7/1994 | United Kingdom | 49/50 |
| 2277548 | 11/1994 | United Kingdom . | |
| 2278872 | 12/1994 | United Kingdom | 49/50 |

*Primary Examiner*—Christopher T. Kent
*Assistant Examiner*—Brian E. Glessner
*Attorney, Agent, or Firm*—Mason, Kolehmainen Rathburn & Wyss

[57] ABSTRACT

A security closures are adapted to be secured over windows or other openings in a wall of a building. The security closures are fixed to the building in a manner to substantially prevent removal of the closure from the exterior of the building. On the other hand, the security closures provide ways to secure the security closures from the interior of the building while minimizing any obstruction to work being done inside the building.

13 Claims, 3 Drawing Sheets

SECURITY CLOSURE

BACKGROUND OF THE INVENTION

1. Field of the Invention

This invention relates to a security closure for use in covering openings in a building, for example windows or the like.

2. Background of the Invention

If a building is left vacant for more than a short period of time, for example to carry out renovation works, it becomes vulnerable to people breaking into the building for the purposes of theft squatting or vandalism. The normal windows of a building do not provide a high degree of security so it is known to cover the windows to make it more difficult to enter into the building.

A rudimentary way of covering a window is to fasten a wooden board over the outside of the window but this is relatively easy to remove by someone determined to enter the building.

A more secure closure for a window is disclosed in UK Patent GB-B-2,160,248 in which a security closure is formed as a metal panel having a circumferential side wall with an inwardly turned rim. The panel is held with the rim against the outside of the opening by means of support beams captively retained by the inwardly turned rim of the panel and which are tied by connecting rods to anchor beams spanning the opening on the inside of the building. The connecting rod is tightened so the wall of the building around the opening is clamped between the panel and the anchor beam.

The use of an anchor beam does, however, have a number of drawbacks, the primary being that the bar extends on the interior surface of the wall thus preventing decoration of the area immediately surrounding the window whilst the closure is in place. As explained above, the security closures are normally used when the building is being renovated which will generally includes redecorating as the final step. At present, the security closures are often removed for the redecoration step, but this is precisely the time that the building is most vulnerable to vandalism and break-ins as valuable property will now have been installed in the building.

It would be possible to simply cut an anchor beam to fit exactly inside the recess of the window or other aperture, but such a beam would still interfere with decoration of the window frame and the recess. What is more, an essential feature of temporarily fitted security closure is the re-usability of security closure which is effectively prevented by the cutting of the anchor beam.

SUMMARY OF THE INVENTION

The present invention seeks to provide ways of securing a security closure without the use of an anchor beam extending across the recess on the interior side of the wall.

The present invention provides two ways of addressing this problem.

According to a first aspect of the present invention, there is provided a security closure for closing an opening in a wall, comprising a screen with an inwardly turned rim and a beam securable across the opening, wherein the screen is securable to the beam by fixing means comprising mounting means arranged to support the screen on the beam and securing means arranged to secure the screen to the beam so that the inwardly turned rim encloses the beam. Thus, the screen is secured without any apparatus on the interior of the building, whilst the security closure maintains a relatively high degree of security with none of the fixings (i.e. bolts, rivets, etc.) outside of the closure and so unprotected by the screen. This aspect of the invention is particularly useful in situations where no connection can be made from inside of the building to the outside.

Preferably, the mounting means comprises a bracket fixed to the interior side of the screen and arranged to be supportable on the beam by support arms of the bracket. so the beam supports the screen during fixing of the closure to the building making this operation easier.

In situations where a tool is inserted through an opening in the screen to secure the screen to the beam, the securing means may be vulnerable to tampering when the security closure is in use. Advantageously, plate means are provided on the interior of the screen biased to a position where the plate means obscures the opening for the tool and movable to a position where the opening is not obscured.

According to a second aspect of the present invention, there is provided a security closure for covering an opening in a building, comprising a screen arranged to abut an exterior surface of the building around said opening, anchor means, and connecting means arranged to connect the screen to the anchor means in an arrangement with the wall clamped therebetween, wherein the anchor means comprises an elongate beam and an arm extending longitudinally and towards the screen from adjacent each end of the beam, where the end of each arm spaced from the beam is the only part of the anchor means arranged to abut the building. The arms normally extend longitudinally in opposite directions from each other. The second aspect of the invention provides a way to allow for decoration in the area of the opening as the arms can be arranged to abut on, for example, the window frame of the opening. This embodiment is particularly advantageous as there is no need to fix a beam to the exterior of the building which is often undesirable and awkward.

Advantageously, the end of each arm spaced from the beam comprises an edge with a small longitudinal extent, so that the arm can be fitted precisely into a corner. This minimizes the amount of obstruction caused by the anchor means.

Preferably one or each arm is slidable along beam or otherwise moveable to adjust the distance between the ends of the arms spaced from the beam from one another. This provides adjustment of the length of the anchor means and makes the same anchor means suitable for a large number of openings without the need of permanent alteration of the anchor means.

According to a third aspect of the present invention, there is anchor means for securing a security closure over an opening in a building, comprising an elongate beam and an arm extending from adjacent each end of the beam, where each arm extends from the beam laterally in the same direction and one arm extends from the beam longitudinally in one direction and the other arm extends longitudinally in the other direction, the end of each arm spaced from the beam is arranged to abut the building adjacent the opening. The anchor means of the second aspect of the invention can, of course, be used in any security closure.

According to a fourth aspect of the present invention there is provided a method of securing a security closure over an opening in a building, comprising the steps of:

a) positioning a security screen over the opening so that the screen completely covers the opening on an exterior side of the building;

b) arranging over the opening on the interior side of the building anchor means comprising an elongate beam with an arm extending from adjacent each end of the beam, each arm extending longitudinally and towards the screen;

c) connecting the screen to the anchor means by connecting means so that the building is braced therebetween and the end of each arm spaced from the beam abuts the interior side of the building.

BRIEF DESCRIPTION OF THE DRAWING

Embodiments of the present invention will now be described, by way of example only, with reference to the accompanying drawings in which.

DETAILED DESCRIPTION OF THE PREFERRED EMBODIMENT

Figure 1:
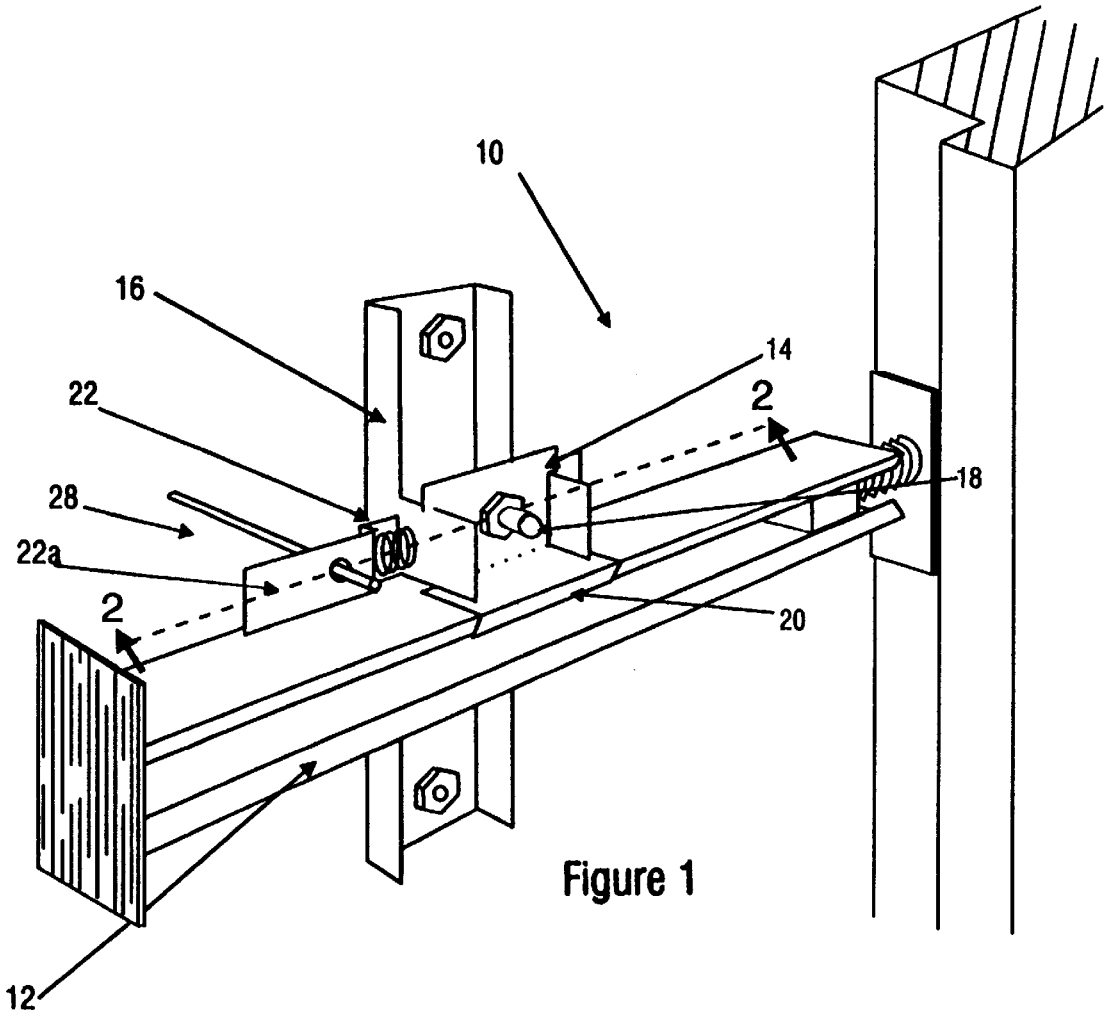
FIG. 1 depicts a fixing arrangement of a security closure according to a first embodiment of the present invention.
Figure 2:
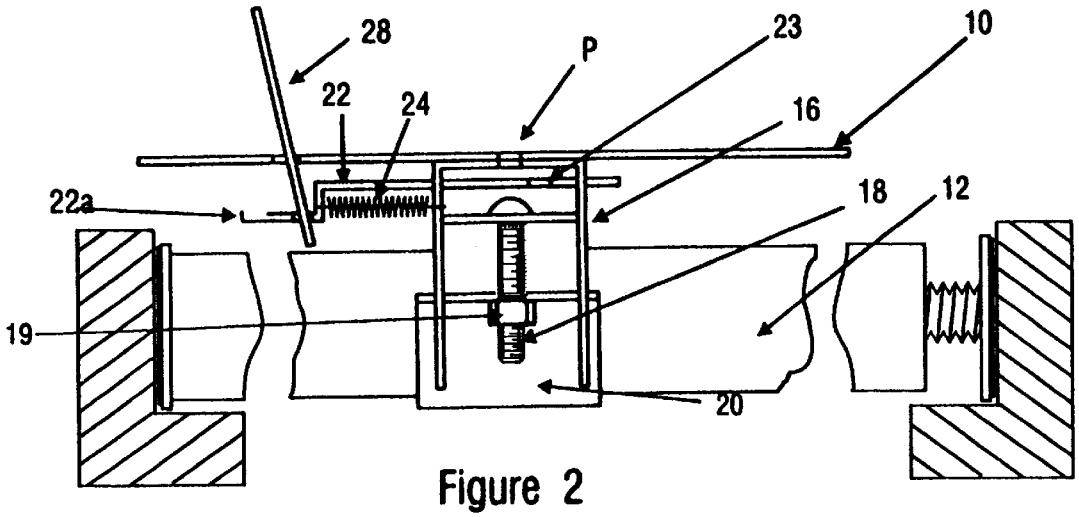
FIG. 2 is a cross-sectional view taken along the 2—2 of FIG. 1.

The first embodiment of the invention is shown in FIGS. 1 and 2. The first embodiment does not utilize an anchor bar on the inside of the building which is particularly required in situations where there is no way to pass a connecting member through, for instance, the window of a building, for example when there are no lights in the window.

A security screen 10 is secured over an opening in the building (not shown) by attachment to a beam 12. The security screen 10 may be made from steel, iron, or other material which has the necessary strength and the screen may be perforated. The screen 10 has an inwardly turned rim (not shown) which abuts the building around the opening therein.

The beam 12 extends across the opening and is fixed to the exterior of the building by means such as expanding bolts. The rim of the screen 10 encircles the beam 12 so that the beam is completely enclosed by the screen 10. In this way the fixing of the beam 12 to the building is protected from tampering when the screen 10 is fitted over an opening in a building, i.e. when the security closure is in use.

The screen 10 is secured to the beam by fixing means 14 which comprises bracket 16, bolt 18, nut 19 and hook 20. The screen could, of course, be secured directly onto the beam by a nut and bolt arrangement (in an embodiment not shown), but this is not preferred as it would be necessary for the fitter to support the screen in exact alignment with the beam as the screen is fitted which is considered to be awkward.

The bracket 16 is fixed to the interior surface of the screen 10 and has a pair of support arms extending parallel to one another further interiorally from the interior surface of the screen 10. The hook 20 is sized to fit onto the support arms and slide along an upper surface of each of the support arms. As shown in the illustrated embodiment, the hook 20 may have flanges arranged to extend under bottom surfaces of the support arms which provides for simpler fitting of the security closure as explained below.

The hook 20 is arranged to engage the beam 12 and, when the illustrated embodiment is used, the engagement will be on the building-side of the beam 12. The nut 19 is fixed to the hook 20. The bolt 18 extends through apertures formed in the bracket 16 and the hook 20 and is fitted to the nut 19.

The screen 10 is secured to the beam 12 by the following method:

1. the hooks 20 is fitted on to the bracket 16 with the nut 19 and bolt 18 fitted together but the hook remaining free to slide along the support arms of the bracket 16. The flanges of the hook 20 providing stability to this intermediate position;
2. the screen 10 is then placed over an opening in a building with a beam 12 fixed over the opening with the fixing means 14 on the building (interior) side of the screen 10;
3. the fixing means 14 has been arranged so that the screen 10 can be lowered until the fixing means rests on the beam 12 and in this position the screen 10 completely covers the opening in the building and the weight of the screen is supported by the beam 12 via the fixing means 14;
4. the bolt 18 is then turned so as to draw the hook 20 along the support arms of the bracket 16 towards the screen 10 and so the hook moves until it engages the beam 12 and then the screen 10 is pulled towards the building until the inwardly-turned rim of the screen 10 abuts the building around the opening.

Normally, the bolt 18 is turned by a tool inserted through a perforation P provided in the screen 10. As mentioned above, the screens are often perforated in any case.

The illustrated embodiment is shown with anti-tampering means provided to reduce tampering with the bolt 18 when the screen is in use. The anti-tampering means comprises plate 22 which has an aperture 23 formed therein and is mounted on the interior of the screen 10 to extend over the perforation P between the screen 10 and the bolt 18. The aperture 23 is of similar size to the perforation P in the screen 10. The plate 22 is biased by spring 24 to a first position (shown) where the aperture 23 is not in line with the perforation P and the bolt 18 and thus obscures the bolt 18 from the exterior of the security closure. The plate 22 is movable to a second position (not shown) where the aperture 23 is in line with the perforation P and the bolt 18 and in the second position the tool can be used to turn the bolt 18.

The plate 22 is movable from its first position to its second position by means of a lever 28 inserted through a second perforation in the screen 10. The lever 28 cooperates with a portion 22*a* of the plate 22. The portion 22*a* is spaced from screen 10 so that the edge of the second perforation in the screen 10 can be used as pivot for the lever 28.

The plate 22 may be either stable or unstable in its second position. If the plate is unstable in its second position the lever 28 must be used to keep it in the second position whilst the tool is used to rotate the bolt 18.

The number of points where a screen will need supporting will vary depending on the size of the screen. Often there will be more than one fixing means 14 securing the screen 10 to each beam 12. There may also be more than one beam 12 in each security closure.

Figure 3:
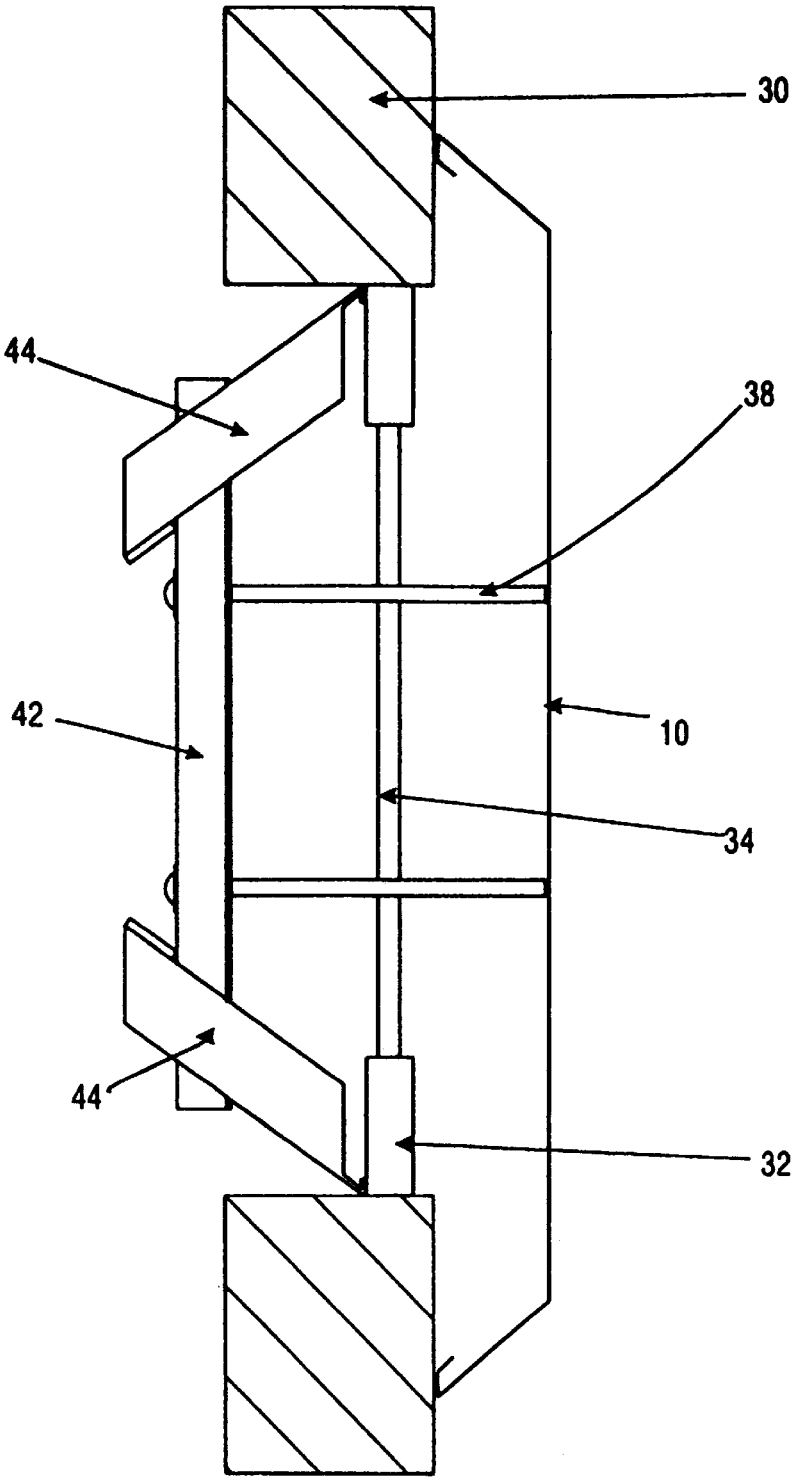
FIG. 3 depicts a cross-sectional view through a security closure according to a second embodiment of the invention.

FIG. 3 illustrates a second embodiment of the invention. The screen 10 is similar to the screen of the first illustrated embodiment and the screen is shown with the inwardly turned rims abutting the wall on two sides of the opening in the building 30. In FIG. 3, the opening is a window 34 bounded by window frame 32.

The screen 10 is secured via connecting ties 38 to anchor means. The connecting ties 38 may be nuts and bolts, flexible tethers with a threaded end and nuts, any other suitable links. Although the connecting ties 38 are shown connected directly to the screen 10, normally the connecting ties will actually engage a beam (not shown) mounted onto the screen as described in GB-A-2,160,248 and European Patent Application Number 96301153.1 from which prior art documents details can be obtained and the contents incorporated by reference.

The anchor means comprises a elongate beam 42 and a pair of arms 44. The beam 42 is similar to a anchor beam as used in the prior art except that the longitudinal extent of the beam 42 may be less than that required to span the opening in the building. One arm 44 extends from adjacent a respective end of the beam 42 so that the end of the arm 44 distal from the beam 42 extends past the respective end of the beam 42 in the longitudinal direction of the beam 42. Both arms 44 also extend laterally with respect to the beam 42.

The distal end of each arm 44 forming the only contact between the anchor means and the building. In this way the anchor means allows access to virtually all of the interior of the building and normally, as shown in FIG. 3, the distal ends of the arms 44 are arranged to abut the window frame 32, and due to the angled nature of the arms 44 allows access to all of the interior wall of the building for example to allow decoration of the wall with the security closure in place.

Although the arms 44 may be fixed to the beam, or pivotably connected thereto. Preferably, at least one of the arms is movable on the beam to allow adjustment of the overall longitudinal extent of the anchor means. Preferably, the arms 44 are slidable on the beam 42 and may take the form of the arms shown in FIG. 4.

Figure 4:
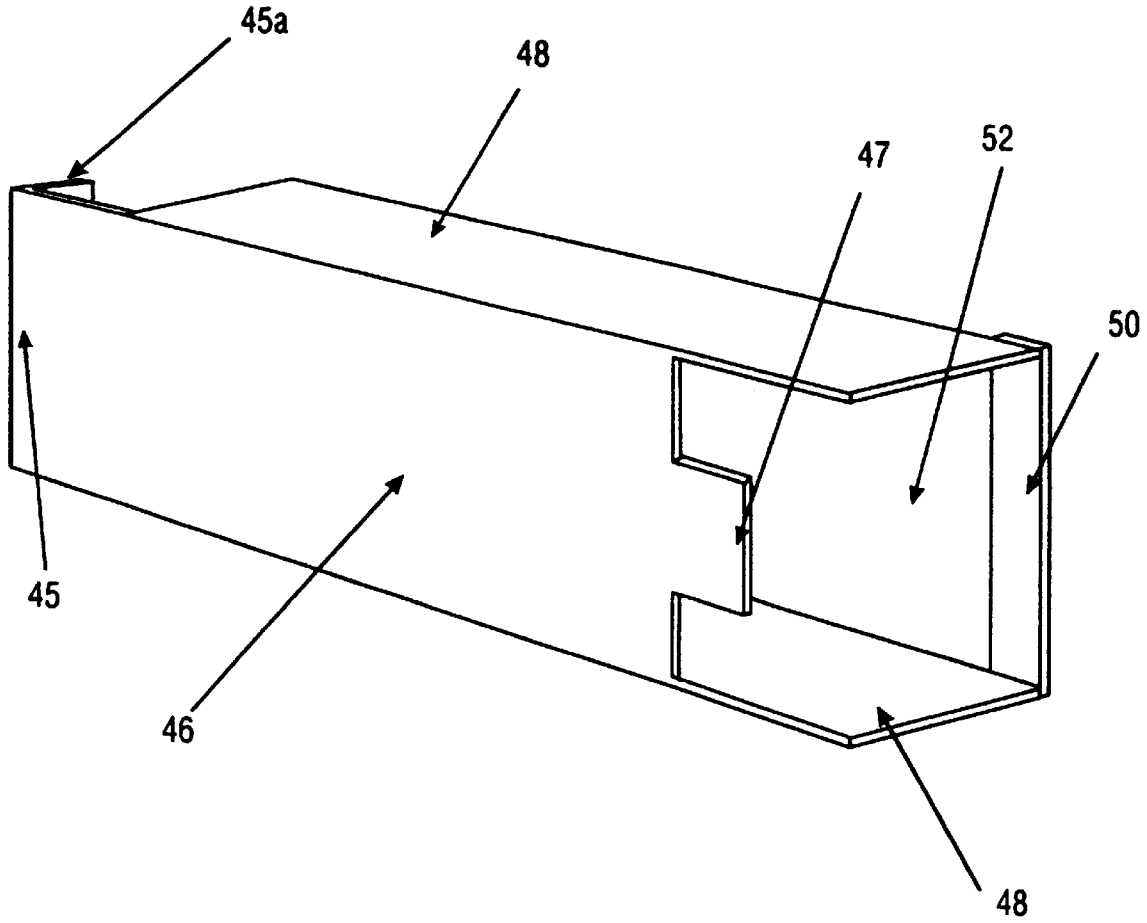
FIG. 4 depicts a perspective view of an arm according to the present invention suitable for use with the second embodiment thereof.

In the illustrated embodiment of FIG. 4, the arm 44 comprises a member, for example of iron, steel, plastics material, etc., which has a plate section 46 with two side wall sections 48 extending from opposed sides of the plate section 46. The two side wall sections 48 extend past a top edge 47 of the plate section 46 and the two ends of the side wall sections 48 are joined together by a bar section 50.

The extensions of the side wall sections 48, the top edge 47 of the plate section and the bar section together define an opening 52 in the arm 44. The opening 52 is sized to allow the arm 44 to slide over the beam 42 of FIG. 3. The plate section 46 and side wall sections 48 may be formed from a sheet of material, such as iron, to which the bar section 50 is fixed, e.g. by welding.

Preferably, the end 45 of the plate section 46 opposite the top edge 47 forms a protrusion from the plate section 46 without side walls 48 extending from this region of the sides of the plate section 46. This is the end of the arm 44 which will be distal from the beam 42 and, in use, will be in contact with the building. As shown, the end 45 may preferably have a lip 45*a*. Advantageously, the end 45 will contact the building along an edge thus minimizing the contact area. In use, the anchor means would normally be installed with the ends 45 extending into a corner such as that formed between window recess and the window frame. In this way it is envisaged that even decoration of the window frame can also be accomplished with the security closure in place.

As mentioned in connection with the first embodiment, the number of points where a screen will need supporting will vary depending on the size of the screen. In some situations, more than one anchor means according to the second embodiment may be used in a security closure.

It is also possible to use a combination of the fixings according to the first and second embodiments, for example where the window or other opening only has lights in the top half of the window, but requires support on the top and bottom halves of the screen. It is also possible to use combinations of fixings according to the present invention and those known from the prior art.

There is provided security closures for securing over windows in a building. The security closures are fixed to the building in a manner to effectively prevent removal of the closure from the exterior of the building. The security closures of this invention provide two ways to secure the security closures whilst minimizing obstruction to decorating work inside the building.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. In combination with a wall having an opening extending therethrough, a security closure for closing said opening in said wall, said security closure comprising a screen disposed on one side of said opening and having an inwardly turned rim and a beam secured across the opening and to said wall on said one side of said opening, wherein said screen is securable to said beam by fixing means arranged to support said screen on said beam and to secure said screen to said beam so that the inwardly turned rim encloses said beam.

2. The security closure according to claim 1, wherein the fixing means comprises a bracket having support arms, the bracket being fixed to an interior side of the screen and arranged to be supportable on the beam by the support arms of the bracket.

3. The security closure according to claim 1, wherein the fixing means comprises a bracket fixed to an interior side of the screen with a threaded stud extending interiorally from the bracket, the stud being arranged to be securable to nut means fixed in relation to the beam.

4. The security closure according to claim 3, wherein said bracket has support arms and is arranged to be supportable on the beam by the support arms of the bracket.

5. The security closure according to claim 3, wherein the screen includes an opening extending from an exterior side of said screen to said interior side of said screen and the threaded stud is arranged to be rotatable by means of a tool inserted through said opening in the screen which opening is sized to just accommodate the tool.

6. The security closure according to claim 5, wherein plate means is provided on the interior of the screen, said plate means being biased to a position where the plate means obscures the opening and being movable to a position where the opening is not obscured.

7. A security closure for covering an opening in a building wall having opening edges extending from an exterior side of said building wall to an interior side of said building wall, said security closure comprising:

a screen arranged to abut against said building wall around said opening on said exterior side of said building wall;

anchor means disposable on said interior side of said building wall; and connecting means extending from said screen to said anchor means such that said building wall is disposable between said screen and said anchor means;

said anchor means comprising an elongated beam having a longitudinal axis extending between first and second ends, a first arm extending from said beam at a first oblique angle with respect to said longitudinal axis towards said screen from adjacent said first end of said beam and a second arm extending from said beam at a second oblique angle with respect to said longitudinal axis towards said screen from adjacent said second end of said beam, said first arm having a first arm end adopted to abut said opening edge of said building wall and said second arm having a second arm end adapted to abut said opening edge of said building wall.

8. The security closure according to claim 7, wherein at least one of said first and second arms is moveable with respect to said beam to adjust the distance between said first and second arm ends to thereby adjust the distance between where said first and second arm ends are adapted to abut against said opening edge of said building wall.

9. The security closure according to claim 7, wherein said first and second oblique angles are such that said first and second arms extend away from each other as said first and second arms extend away from said beam toward said opening edge of said building wall.

10. An anchor means for securing a security closure over an opening in a building wall having opening edges extending from an exterior side of said building wall to an interior side of said building wall, said anchor means comprising:

an elongated beam having a longitudinal axis extending between first and second ends and being disposable on said interior side of said building wall, a first arm extending from said beam at a first oblique angle with respect to said longitudinal axis towards said exterior side of said building wall from adjacent said first end of said beam and a second arm extending from said beam at a second oblique angle with respect to said longitudinal axis towards said exterior side of said building wall from adjacent said second end of said beam, said first arm having a first arm end adapted to abut said opening edge of said building wall and said second arm having a second arm end adapted to abut said opening edge of said building wall.

11. An anchor means according to claim 10, wherein at least one of said first and second arms is slidable along the beam to adjust the distance between said first and second arm ends to thereby adjust the distance between where said first and second arm ends are adapted to abut against said opening edge of said building wall.

12. A method of securing a security closure over an opening in a building wall, comprising the steps of:

a) positioning a security screen over the opening so that the screen completely covers the opening on an exterior side of the building wall;

b) arranging over the opening on an interior side of the building wall anchor means comprising an elongated beam having a longitudinal axis with an arm extending from adjacent each end of the beam, each arm extending at an oblique angle with respect to said longitudinal axis and towards the screen; and c) connecting the screen to the anchor means by connecting means so that the building wall is disposed therebetween and the end of each arm spaced from the beam abuts the building wall between said exterior and interior sides of the building wall.

13. The method according to claim 12, wherein the end of each of the arms spaced from the beam contacts the building in a corner formed between a window recess and a window frame in the building wall.

* * * * *